US005154972A

United States Patent [19]

Mizutani

[11] Patent Number: 5,154,972

[45] Date of Patent: Oct. 13, 1992

[54] INK RIBBON TO BE USED FOR PRODUCING A DRY TRANSFER MATERIAL

[75] Inventor: Tadashi Mizutani, Nagoya, Japan

[73] Assignee: Brother Kogyo Kabushiki Kaisha, Nagoya, Japan

[21] Appl. No.: 742,431

[22] Filed: Aug. 8, 1991

[30] Foreign Application Priority Data

Oct. 25, 1990 [JP] Japan ..... 2-288206

[51] Int. Cl.[5] ..... B41M 5/165

[52] U.S. Cl. ..... 428/321.5; 428/195; 428/336; 428/914

[58] Field of Search ..... 428/321.5, 914, 403, 428/336, 70, 73, 42, 195, 906, 132

[56] References Cited

U.S. PATENT DOCUMENTS 4,652,486 3/1987 Tasaka et al. ..... 428/321

4,870,427 9/1989 Kobayashi et al. ..... 346/1

FOREIGN PATENT DOCUMENTS 63-251287 10/1988 Japan .

*Primary Examiner*—Bruce H. Hess

*Assistant Examiner*—W. Krynski

*Attorney, Agent, or Firm*—Oliff & Berridge

[57] ABSTRACT

An ink ribbon for producing a dry transfer material, the ribbon having a layer including a microcapsule encapsulated adhesive and a layer including a microcapsule encapsulated mold releasing agent coated on the ribbon substrate so that the adhesive and the release agent are nonfunctional until the microcapsules are ruptured by pressure. Thus, the microcapsules may contain an adhesive having an adhesive property and a mold releasing agent having a release property stronger than that included in the resin having a pressure-sensitive property of the conventional ink ribbons.

21 Claims, 8 Drawing Sheets

Fig.5(A)

| | SCRATCH STRENGTH |
|---|---|
| SAMPLE 1 | 5.0 |

Fig.5(B)

| | SCRATCH STRENGTH |
|---|---|
| SAMPLE 2 | 5.5 |

Fig.5(C)

| | SCRATCH STRENGTH |
|---|---|
| CONVENTIONAL SAMPLE | 1~2 |

Fig.6(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.6(B)

| | TIME(hr.) | | |
|---|---|---|---|
| | 0~240(hr.) | 240~480(hr.) | 480~720(hr.) |
| SAMPLE 2 | 0/100 | 0/100 | 0/100 |

Fig.6(C)

| | TIME(hr.) | | |
|---|---|---|---|
| | 0~240(hr.) | 240~480(hr.) | 480~720(hr.) |
| CONVENTIONAL SAMPLE | 10/100 | 60/100 | 91/100 |

Fig.7(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.7(B)

| | TIME(hr.) | | |
|---|---|---|---|
| | 0~240(hr.) | 240~480(hr.) | 480~720(hr.) |
| SAMPLE 2 | 0/100 | 0/100 | 0/100 |

Fig.7(C)

| | TIME(hr.) | | |
|---|---|---|---|
| | 0~240(hr.) | 240~480(hr.) | 480~720(hr.) |
| CONVENTIONAL SAMPLE | 10/100 | 60/100 | 91/100 |

INK RIBBON TO BE USED FOR PRODUCING A DRY TRANSFER MATERIAL

BACKGROUND OF THE INVENTION

1. Field of the Invention

This invention relates to an ink ribbon for thermal transfer printing, and more particularly to an ink ribbon to be used for producing a dry transfer material which is capable of transferring an ink image onto a surface of a receiving material that has a poor wetting property and high releasability. The ink ribbon is used with a thermally transfer printing type printer, typewriter or word processor. The ink that is transferred to a transfer sheet is capable of transfer printing effectively onto a receiving material upon application of pressure to a back surface of the transfer sheet.

2. Description of Related Art

Recently, a device for producing a dry transfer material which comprises a transfer sheet for dry transfer material and a ribbon cartridge in which an ink ribbon for producing the dry transfer material is stored has been developed and used widely. As such a device, Tape Printer "P-touch", manufactured by Brother industries, Ltd., is well known. A thermal head is installed in the device for producing the dry transfer material. The ink ribbon for producing the dry transfer material is brought into contact with a transfer sheet by the thermal head and a number of heating elements aligned on the thermal head are caused to generate heat according to electrical signals, whereby the ink on the ribbon in contact with the heating elements is heated through a base sheet of the ribbon and fused onto the transfer sheet.

Further, as described in U.S. Pat. No. 4,870,427 (corresponding to Japanese Laid-Open Patent Publication No. 63-128990, Japanese Laid-Open Patent Publication No. 63-128991, etc.), the ink ribbon for producing the dry transfer material comprises an ink layer which is arranged on a film-like ribbon substrate and contains a resin having a pressure-sensitive adhesive property, with a coloring matter therein, and a control layer which is arranged on the ink layer and contains a resin having a thermo-sensitive adhesive property.

Another ink ribbon for producing dry transfer material comprises, as described in Japanese Laid-Open Patent Publication No. 63-251287, a layer arranged on a film-like ribbon substrate and contains a resin having a pressure-sensitive adhesive property and an ink layer which is arranged on the resin layer. The ink layer contains a resin having a thermal-sensitive adhesive property and a coloring matter.

The user installs a ribbon cartridge, in which an ink ribbon for producing dry transfer material is stored, in the device for producing the dry transfer material. The user then inputs the characters or figures, by means of a keyboard or other external data source, that the user wants recorded on the dry transfer material. Following the data input, only the heat-generating elements of the device corresponding to the characters or figures to be recorded are heated according to the input character and figure data. The ink of the ink ribbon for producing the dry transfer material is transferred to a transfer sheet, the transfer sheet formed by a transparent resin sheet, whereby the dry transfer material, that is the transferred images consisting of characters and figures are formed on the transfer sheet, is produced. To use the dry transfer material, the user presses the dry transfer material against a receiving material and transfers the ink image onto the surface of the receiving material.

However, there is a problem that the quality of the transferred image is not good as produced by transferring from the dry transfer material to the receiving material.

To transfer the known dry transfer material, the user must place the side of the transfer sheet having the ink transfer image in contact with the receiving material such as paper, plastic, metal, and wood, and then the user must rub the back side of the transfer sheet for a long period of time.

However, it is difficult to obtain a high quality transferred image because the collapse and spreading of the ink transferred image that results if the transfer sheet is insufficiently fixed with respect to the receiving material surface and the transfer sheet shifts position during the rubbing and transfer.

The inventors of the invention studied the problem and found the reason why the user had to keep rubbing the transfer sheet for such a long period of time, was because the pressure-sensitive adhesive property of the resin, such as described in EXAMPLE 2, column 18 of U.S. Pat. No. 4,870,427, was weak.

OBJECTS AND SUMMARY OF THE INVENTION

It is an object of the present invention to overcome the above described drawbacks and disadvantages of known transfer materials, and to provide an ink ribbon for producing a dry transfer material capable of easily transferring an ink transfer image that has been transferred onto a transfer sheet to the surface of a receiving material so that the transferred image has a perfect shape without collapse.

Another object of the present invention is to provide an ink ribbon for producing dry transfer material such that there is no residual ink remaining on a transfer sheet when the ink transfer image is transferred onto the surface of the receiving material by applying pressure to the back side of the transfer sheet.

It is another object of the present invention to provide an ink ribbon for producing dry transfer material such that the strength of resistance to scratches or scrapes on a surface of a transferred image will be greatly improved by improving the adherence between the transferred image and the surface of the receiving material and to strongly adhere the retransferred image to the receiving material.

It is another object of the invention to provide an ink ribbon for producing dry transfer material capable of completing the transfer in a very short time by application of a limited amount of pressure to the back side of the transfer sheet.

To attain these and other objects, according to the invention, there is provided an image-transferable ink ribbon to be used for producing dry type image-transfer material, the ink ribbon comprising: a ribbon substrate material and layers formed on the ribbon substrate material, the layers including the dry type image-transfer material, first microcapsule encapsulated adhesive and second microcapsule encapsulated mold releasing agent, respectively. The layer including the microcapsule encapsulated adhesive is next to the ribbon substrate material and the layer including the microcapsule encapsulated mold releasing agent is on the outer layer with respect to the ribbon.

According to the invention thus structured, the transfer sheet produced from the ink ribbon has a layer including the microcapsule encapsulated mold releasing agent adjacent the sheet, the layer including the microcapsule encapsulated adhesive in the outermost layer so that it faces the receiving material during use. Thus by application of pressure to the back side of the transfer sheet, both the adhesive and the mold releasing agent act to provide that the ink transfer image is completely separated from the transfer sheet and is strongly adhered onto the receiving material.

Therefore, there is no residual ink left on the transfer sheet when the user applies pressure to the back side of the transfer sheet and an ink transfer image is transferred from the transfer sheet onto the receiving material. There are no collapse, spreading and brittleness of the transferred image and the transferred image adheres to the receiving material strongly producing an excellent image.

BRIEF DESCRIPTION OF THE DRAWINGS

The foregoing and other objects, features and advantages of the invention will become more apparent by reading the following detailed description of the preferred embodiments of the invention, when considered in connection with the accompanying drawings, in which:

FIG. 5(A)-5(C) are tables of a data showing the scrape-resistance of a pressure-sensitive retransfer image obtained from using the first and second embodiments of the invention and that of the related art;

FIG. 6(A)-6(C) are tables of a data showing the shelf life of the dry transfer material produced from the first and second embodiments and that of the related art;

FIG. 7(A)-7(C) are tables of a data showing a shelf life of the pressure-sensitive transferred image formed on a receiving material by the dry transfer material produced from the first and second embodiments and that of the related art;

DETAILED DESCRIPTION OF THE PREFERRED EMBODIMENTS

Figure 1:
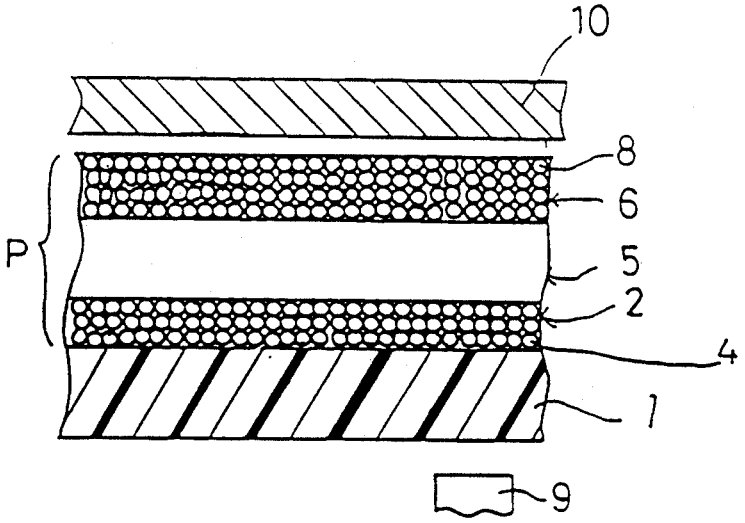
FIG. 1 is an expanded sectional view of a first embodiment of an ink ribbon for producing dry transfer material.

FIG. 1 is an expanded sectional view showing an ink ribbon for producing dry transfer material of a first embodiment. As shown in FIG. 1, the ink ribbon for producing dry transfer material is composed of a film-like ribbon substrate 1 with a first pressure-sensitive retransfer adjustment layer with adhesive 2, an ink layer 5 and a second pressure-sensitive retransfer adjustment layer with mold releasing agent 6 provided thereon.

Figure 2:
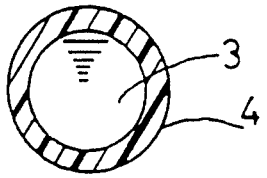
FIG. 2(A) is an expanded sectional view of a microcapsule containing an adhesive.
FIG. 2(B) is an expanded sectional view of a microcapsule containing a mold releasing agent.
Figure 2:
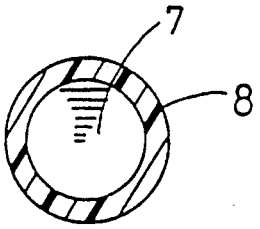

The first pressure-sensitive retransfer adjustment layer 2 is a layer which includes microcapsules 4 containing an adhesive 3 as shown in FIG. 2(A). When the microcapsules 4 are ruptured by an external pressure, the adhesive contained therein flows out and an adhering action is performed.

The ink layer 5 contains a coloring agent, a thermosensitive adhesive component, and a pressure-sensitive adhesive component.

The second pressure-sensitive retransfer adjustment layer 6 includes microcapsules 8 containing a mold releasing agent 7. When the microcapsules 8 are ruptured by an external pressure, the mold releasing agent contained therein flows out and a releasing action is performed. An ink containing transfer layer P thus comprises the first pressure-sensitive retransfer adjustment layer 2 (hereinafter called first adjustment layer), the ink layer 5, and the second pressure-sensitive retransfer adjustment layer 6 (hereinafter called second adjustment layer).

The ink ribbon is used with a printing device having a thermal head 9 having a number of heat-generating elements (not shown), and an electrical circuit for heating only the heat-generating elements which correspond to characters or figures to be recorded on a transfer sheet 10 when the characters and figures have been defined by an operator using an input device. The ink containing transfer layer P is transferred to the transfer sheet 10 using the thermal head 9. At this time, the second adjustment layer 6 of the ink containing transfer layer P is adhered to the transfer sheet 10 (refer to FIG. 3). The ink containing transfer layer P of the transfer sheet 10 is then faced to a receiving material W and a pressure is applied to the side 10A. The microcapsules 4 and 8 are ruptured thereby and the mold releasing agent and the adhesive flow from the ruptured microcapsules. As a result, the ink containing transfer layer P is quickly and easily transferred to the receiving material W.

The adhesive 3 used in the invention is not limited specially, but is an adhesive which stiffens in a very short time and develops its adhesive strength simultaneously. To meet these conditions, it is preferred that the adhesive is of a cyanoacrylate instantaneous adhesive of a one-fluid type, an epoxy adhesive of a two-main fluid type, an acrylic adhesive of a two-main fluid type, a two-fluid type acrylic adhesive of a main-fluid and a primer, or a cyanoacrylate instantaneous adhesive of a main-fluid and a primer.

The mold releasing agent 7 used in the invention is also not limited but a mold releasing agent having a strong mold releasing property is preferred. Thus, it is preferred that the mold releasing agent be one of a silicon oil, a fluorine resin, an olefin resin, a paraffin wax or other comparable waxes.

For the wall material of the microcapsules 4, 8, to be ruptured by application of an external pressure, well-known materials such as melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, polyurethane resin, and polyurea can be used.

Further, a desirable capsule diameter of the microcapsules 4, 8 is in the range of 0.1-20 μm, and preferably, is in the range of 0.5-10 μm, in order to obtain an excellent retransferred image by a pressure equivalent to a stamp pressure between 50 g/cm$^2$ and 2000 g/cm$^2$. If the capsule diameter of the microcapsules 4, 8 is less than 0.1 μm, the microcapsules are not easily ruptured because the lowest pressure necessary to rupture the microcapsules is great. On the other hand, if the capsule diameter of the microcapsules 4, 8 is more than 20 μm, the transferred image for small characters or figures is not satisfactory.

A desirable coating thickness for the first and second adjustment layers 2, 6 containing the microcapsules 4, 8, respectively, is in the range of 1–20 μm, preferably is in the range of 1–10 μm. If the coating thickness of the microcapsules 4, 8 is less than 1 μm, the adhesive strength which is necessary for obtaining an excellent pressure-sensitive transfer is not obtained. On the other hand, if the coating thickness of the microcapsules 4, 8 is more than 20 μm, the transferred image may be bled by an excessive amount of either the adhesive or the mold releasing agent or both and an excellent transferred image may not be obtained.

As the film-like ribbon substrate 1 to be used for the ink ribbon, various kind of materials may be used. Because the film-like ribbon substrate 1 is brought into contact with a thermal head for thermal transfer printing, the film-like ribbon substrate 1 preferably has a heat resistance of 150 degrees C. or higher. Materials such as resin films which consist of polyester films such as polyethylene terephthalate (PET) and polybutylene terephthalate, polyimide films, polycarbonate films, polysulfone films, polyethersulfone films, polyphenylene sulfide films, or papers such as condenser paper and glassine paper meet this requirement. A desirable thickness of the film-like ribbon substrate 1 in the range of 1 μm to 30 μm. In particular, the optimum thickness is 3–20 μm in order to obtain an excellent transferred image using a pressure equivalent to the stamp pressure of 50–2000 g/cm$^2$. If the thickness of the film-like ribbon substrate 1 is less than 1 μm, the ink ribbon is not smoothly transported in the printing device. On the other hand, if the thickness of the film-like ribbon substrate 1 is more than 30 μm, sufficient heat from the heat generating elements of the thermal head 9 is not transmitted to the pressure sensitive retransfer adjustment layers 2, 6 and the ink layer 5, so that both the adjustment layers 2, 6 and the ink layer 5 are partially transferred onto the transfer sheet 10.

The ink layer 5 is mainly composed of a coloring agent, a thermo-sensitive adhesive component, and a pressure-sensitive adhesive component. Pigments such as carbon black are generally used as the coloring agent. However, if desired, dyes such as a leuco dye, to be colored by an acid, and a diazo dye, to be colored by a base, may be added to adjust the color tone of the ink. The ink is not limited to the noted coloring agents.

As a coloring element of the leuco dye to be colored by acid, materials such as phthalide compound, fluoran compound, lactone compound, triphenylmethane compound, rhodamine lactam compound, and quinone compound can be used. The materials used as the developer for coloring the leuco dye colored are phenol materials or acid materials. The color reaction progresses based on the coloring element and the coloring temperature to color the leuco dye.

The diazo dye, to be colored by a base, is produced by combining a diazo compound, which is an acid material, and a coupling compound which is a basic dye-precursor. It is colored based on the contact between the materials while being heated.

The thermo-sensitive adhesive component of the ink layer 5 may comprise one or more kinds of resin having high thermo-sensitive adhesiveness such as ethylene-vinyl acetate copolymer, poly(vinyl acetate), ionomer, acrylic polymer, ethylene-ethyl acetate copolymer, ethylene-acrylic acid copolymer, vinyl chloride-vinyl acetate copolymer, poly(vinyl butyral), poly(vinyl pyrrolidone), poly(vinyl alcohol), polyamide, and ethyl cellulose.

The pressure-sensitive adhesive component of the ink layer 5 may comprise one or more kinds of material in combination selected from a group consisting of: vinyl polymers such as poly(vinyl chloride), poly(acrylic ether), ethylene-vinyl acetate copolymer, ethylene-ethyl acetate copolymer, poly(vinyl acetate), poly(vinyl ether), poly(vinyl acetal), polyisobutylene; fibrous polymers such as ethyl cellulose, nitrocellulose, cellulose acetate; and rubber(-like) polymers such as rubber chloride and natural rubber.

In addition, a tackifier, a binder agent and a surface modifier may also be contained in the thermo-sensitive adhesive and the pressure-sensitive adhesive components.

The tackifier acts to improve the adhesion and hardness of an ink, to give cohesion and tacking strength to the ink, and to give tackiness to the thermo-sensitive adhesive and the pressure-sensitive adhesive components. The tackifier may comprise a mixture of one or more kinds of resin, such as petroleum resin, rosin resin, ketone resin, polyamide resin, and phenolic resin. As the binder agent, one composed of waxes is primarily used. The wax may comprise one or more kinds of material selected from: plant waxes such as candelilla wax, carnauba wax, rice wax, and Japan wax; animal waxes such as bees waxes, lanolin, and whale waxes; mineral waxes such as montan waxes, and ceresin; and petroleum waxes such as paraffin wax, and microcrystalline wax. As the foregoing wax, resin waxes such as α-olefin-maleic anhydride copolymers may also be used.

The surface modifier enables the ink ribbon to have an excellent shelf life, without one layer of the ink ribbon sticking to another (blocking) and to have an excellent running property, without the meander and slipping caused by losing the tackiness on a surface of the ink ribbon, by reducing the frictional resistance. As the surface modifier, materials such as fluorine-contained polymer and silicone polymer may be used.

On the reverse side of the film-like ribbon substrate 1, to that on which the first adjustment layer 2, ink layer 5 and the second adjustment layer 6 are coated, may be placed an anti-sticking layer which may be composed at least of one or more kinds of material selected from a heat-resistant resin such as silicon resin and pigments such as barium sulfate, titanium oxide, aluminum hydroxide, zinc oxide, and calcium carbonate having a color corresponding to that of the film-like ribbon substrate.

The present invention is explained concretely with reference to the following Examples, but the present invention should not be construed as being limited thereto.

EXAMPLE 1

As shown in FIG. 1, a first adjustment layer 2 containing a microcapsule encapsulated adhesive 3, an ink layer 5 and a second adjustment layer 6 containing a microcapsule encapsulated mold releasing agent 7 are placed on a film-like ribbon substrate 1 in order. The ink layer 5 also contains a coloring agent and thermo-sensitive adhesive and pressure-sensitive adhesive components.

Figure 4:
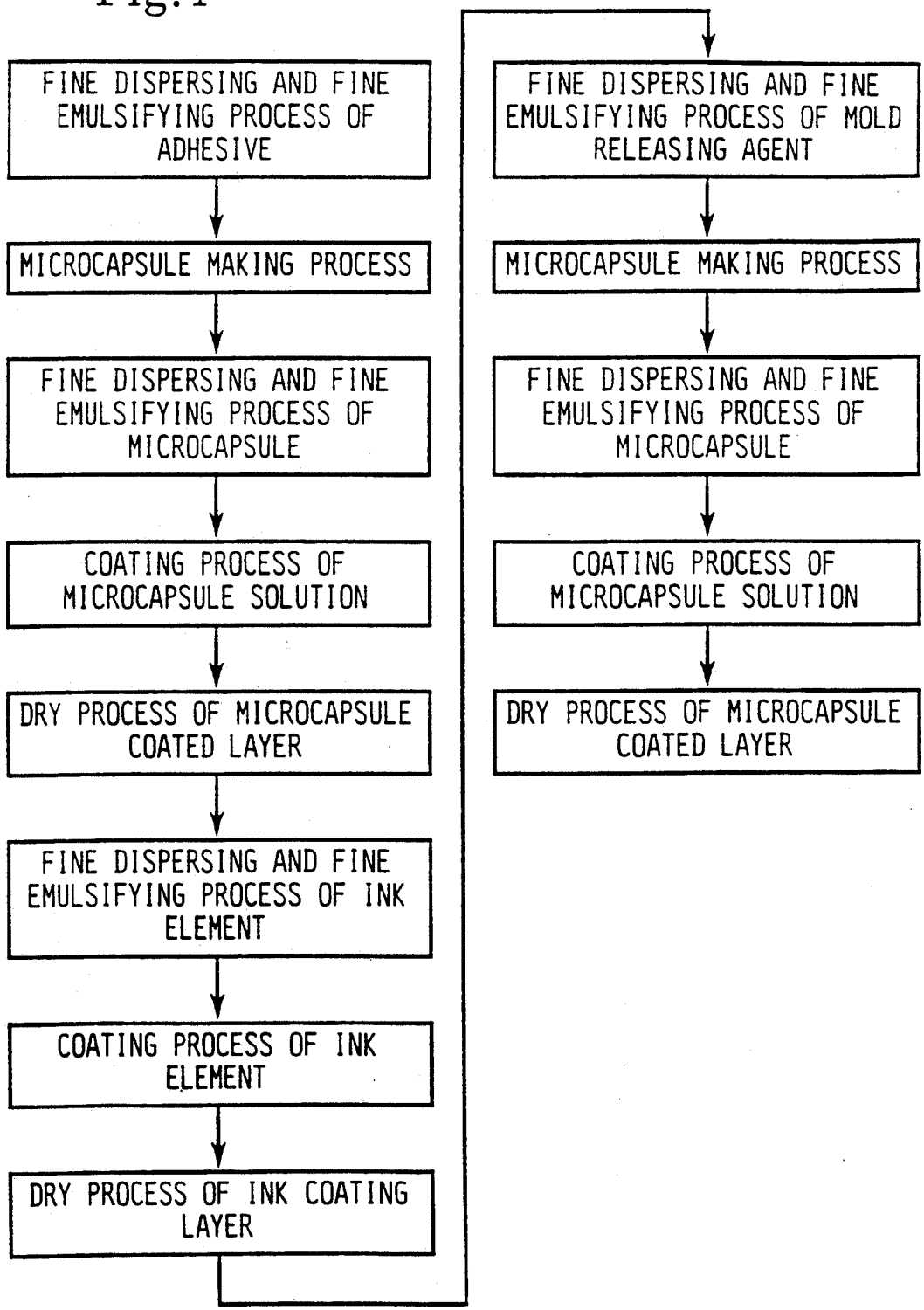
FIG. 4 is a block diagram showing a manufacturing process of the ink ribbon for producing dry transfer material.

The process for manufacturing the ink ribbon of this example, the resulting ink ribbon to be used for producing a dry transfer material, is shown in FIG. 4.

First, a fine dispersing and fine emulsifying process of an adhesive is performed. The process consists of making a fine dispersing solution or a emulsifying solution containing a cyanoacrylate instantaneous adhesive 3 of a one-fluid type by adding the cyanoacrylate instantaneous adhesive 3 to an oil solvent by stirring to atomize the cyanoacrylate instantaneous adhesive 3 therein. A dispersant or an emulsifier is added to the stirred and atomized cyanoacrylate instantaneous adhesive 3 in order to maintain a stable solution or emulsion.

A microcapsule making process is then performed by adding melamine to the stable solution or emulsion of the fine dispersing and fine emulsifying process. The mixture is heated and an oil solvent containing dissolved formaldehyde is added to the heated mixture with stirring to disperse the dissolved formaldehyde throughout the mixture. As a result, a crosslinking polymer of the melamine and the formaldehyde is formed on an interface of a formaldehyde dispersion grain thereby producing the melamine-formaldehyde resin microcapsules containing the cyanoacrylate instantaneous adhesive 3.

Next, a fine dispersing and fine emulsifying process of the microcapsules 4 is performed. The microcapsules 4 and a binder wax are added to an oil solvent. The resultant mixture is stirred to disperse the microcapsules and binder wax throughout the solvent and a dispersant is added to create a stable solution or emulsion.

The microcapsule solution is coated on a film-like ribbon substrate 1, of polyethylene terephthalate (PET), by a well-known coating method such as the bar coating method, the blade coating method, the air-knife coating method, the gravure coating method, the roll coating method, the spray coating method or the dip coating method.

Immediately after being coated on the film-like ribbon substrate, the microcapsule coated layer is heated and dried under atmospheric conditions and a temperature of 110° C. As a result, the first adjustment layer 2 is formed on the film-like ribbon substrate 1.

Next, a fine dispersing or fine emulsifying solution of an ink element is prepared which contains a coloring agent and a pressure-sensitive adhesive component. The solution is made by adding a dispersant or a emulsifier after stirring and atomizing the coloring agent.

The fine dispersing or emulsifying solution is coated on the first adjustment layer 2 by a well-known coating method such as the bar coating method, the blade coating method, the air-knife coating method, the gravure coating method, the roll coating method, the spray coating method or the dip coating method.

The film-like ribbon substrate 1 with first adjustment layer 2, to which the ink element is coated is heated and dried under atmospheric conditions and a temperature of 110° C., to the ink coating layer. As a result, an ink layer 5 is formed on the first adjustment layer 2.

Next, a fine dispersing or fine emulsifying solution of a mold releasing agent is prepared. In this process, a silicon oil mold releasing agent 7, melamine and formaldehyde are dissolved in an oil solvent and added with stirring to an aqueous solution. A dispersant or a emulsifier is added thereto to produce a stable fine dispersing or emulsifying solution which contains the silicon oil mold releasing agent 7.

Then a microcapsule 8 making process is continuously performed. In this process, melamine-formaldehyde resin, which forms the wall material of the microcapsule that are to be ruptured by a specified external pressure, is added, with stirring, to the fine dispersing or emulsifying solution of the mold releasing agent while heat is applied and the microcapsules 8 containing the silicon oil mold releasing agent are formed.

The microcapsules 8, a thermo-adhesive component and a binder wax are then uniformly dispersed or emulsified by stirring in an aqueous solution and a dispersant is added to make a stable, finely dispersed microcapsule solution or emulsion.

The microcapsule solution containing microcapsules 8 is coated on the ink layer 5, using a coating method such as the bar coating method, the blade coating method, the air-knife coating method, the gravure coating method, the roll coating method, the spray coating method or the dip coating method.

The film-like ribbon substrate 1, with the first adjustment layer 2 and ink layer 5 coated thereon, to which the microcapsule solution containing the mold releasing agent has been added, is heated and dried under atmospheric conditions at a temperature of 110° C. to dry the microcapsule containing coated layer. As a result, a second adjustment layer 6 is formed on the ink layer 5. Thereby, as shown in FIG. 1, the first adjustment layer 2, the ink layer 5 and the second adjustment layer 6 are formed on the film-like ribbon substrate 1 in order.

Figure 3:
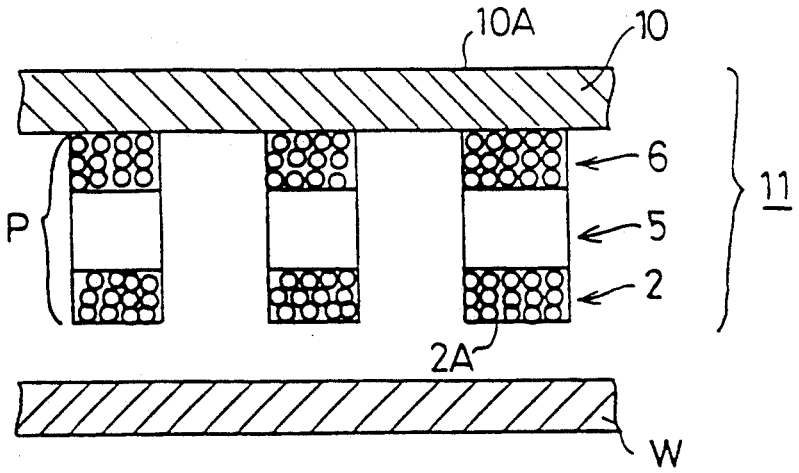
FIG. 3 is an expanded sectional view of a dry transfer sheet of the first embodiment.

FIG. 3 is an expanded sectional view of a dry transfer material made by using the first embodiment of the ink ribbon of the invention. The dry transfer material 11 has the first adjustment layer 2 including the microcapsules 4 containing an adhesive 3, the ink layer 5 and the second adjustment layer 6 including the microcapsules 8 containing a mold releasing agent 7 layered on a transfer sheet 10 with the second adjustment layer 6 adhered to the transfer sheet 10.

The procedure for manufacturing dry transfer material 11 is briefly explained below.

First, the ink ribbon of the invention is stored in a cartridge to create a ribbon cartridge. The ribbon cartridge is installed in a printing device for producing the dry transfer material (for example, Tape Printer "P-touch" manufactured by Brother industries, Ltd.), where it is used with a built-in thermal head 9 to produce the dry transfer material.

Data to be recorded on the transfer sheet 10 is input, and the heat-generating elements of the thermal head 9, corresponding to the characters or figures to be recorded, are heated to a temperature greater than the melting temperature of the first adjustment layer 2, the ink layer 5 and the second adjustment layer 6. Therefore, a desirable ink transfer image is thermo-sensitively transferred onto the transfer sheet 10 to produce dry transfer material 11 having the desired ink transfer images thereon.

When a side 2A of the dry transfer material 11, on which the ink transfer image is formed, it is placed on the surface of a receiving material W, and a pressure equivalent to the stamp pressure is applied to a side 10A of the dry transfer material 11, the microcapsules 4, 8 are ruptured, the adhesive and the mold releasing agent contained therein flows out, and a desired ink transferred image is thereby pressure-sensitively transferred onto a receiving material such as paper, plastic, metal, or wood. The transferred image has an excellent image quality without collapse, spreading, or brittleness.

Moreover, because an adhesive that stiffens in a very short, while simultaneously obtaining its adhesive strength, and a silicon oil mold releasing agent that reduces the adhesion between the second adjustment layer 6 and the transfer sheet 10 in a very short time, are used, the transferred image is obtained in a very short time.

The stamp pressure necessary for pressure-sensitive transfer is set primarily corresponding to the pressure which is necessary to rupture the microcapsules 4, 8. The desirable stamp pressure, as previously noted is 50 g/cm$^2$–2000 g/cm$^2$. The optimum stamp pressure is 200 g/cm$^2$–1000 g/cm$^2$ in order to obtain an excellent transferred image without excessive effort. If the dry transfer material is arranged so that the microcapsules 4, 8 included therein may be ruptured with a stamp pressure of less than 50 g/cm$^2$, the microcapsules 4, 8 are too easily ruptured and the pressure-sensitive transfer is too easily performed. Therefore, the shelf life of the dry transfer material decreases as it is easily damaged. On the other hand, if the dry transfer material is such that the microcapsules 4, 8 included therein are ruptured by a stamp pressure of more than 2000 g/cm$^2$, the microcapsules 4, 8 are not easily ruptured and an excellent pressure-sensitive transferred image is not obtained.

Moreover, the external pressure, such as the stamp pressure, necessary to rupture microcapsules 4 and microcapsules 8 can be the same or different. The invention is not limited to their being the same.

Results obtained by measuring the resistance and scratching of a transferred image obtained by the above-mentioned method, resulting from using a transfer sheet made using the ink ribbon of the invention, and a conventional transferred image were compared and are as shown in FIGS. 5(A) and 5(C), respectively. Sample 1 is based on a transferred image obtained by using a dry transfer material made from the ink ribbon of example 1. The conventional sample was a transferred image obtained by using a dry transfer material made from a conventional ink ribbon that does not include a microcapsule encapsulated adhesive or a microcapsule encapsulated mold releasing agent.

Compared with the conventional transferred image, the adhesiveness between the transferred image obtained by using the dry transfer material made from the ink ribbon of example 1 and the receiving material is greatly improved over that of the conventional sample.

Moreover, the results obtained by observing and comparing the shelf life of the dry transfer material made from the ink ribbon for producing the dry transfer material of Example 1 and the conventional dry transfer material are as shown in FIGS. 6(A) and 6(C), respectively, and the results obtained by observing and comparing the shelf life of the transferred image made using the dry transfer material of this Example 1 and the conventional transferred image are shown in FIGS. 7(A) and 7(C), respectively.

The observation and comparison method employed consisted of visually observing the dry transfer material and the transferred image after being stored continuously in a normal atmosphere at a temperature of 55° C. and 85% relative humidity. The number of samples in the 100 experiment samples on which bleedings, cracks and changes of hue were confirmed was counted as the measure of effectiveness.

In Example 1, the first adjustment layer 2 containing the adhesive and the second adjustment layer 6 containing the mold releasing agent having excellent heatproof and water repellant characteristics were used. As for the dry transfer material and the transferred image obtained from Example 1, no cracks, bleedings and changes of hue were confirmed even after the passage of 480–720 hours. However, the conventional transferred image showed bleedings, cracks and/or changes of hue occurred before 240 hours had passed, and their numbers increased with the passage of time. Therefore, it was found that the shelf life of the conventional transferred image deteriorated overtime while the items produced from this first embodiment ink ribbon of the invention were unaffected.

EXAMPLE 2

Figure 8:
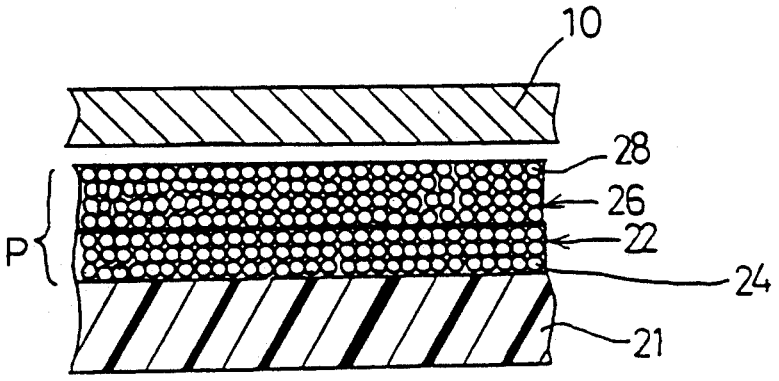
FIG. 8 is an expanded sectional view of a second embodiment of an ink ribbon for producing dry transfer material.

Shown in FIG. 8 is a second embodiment of the ink ribbon of the invention. A first adjustment layer 22 and a second adjustment layer 26 are placed on a film-like ribbon substrate 21 in order. The ink containing transfer layer P is comprised of the two layers, that is, the second adjustment layer 26 includes microcapsules 28 encapsulating the silicon oil mold releasing agent and a coloring agent, which was one element contained in the ink layer 5 of the first embodiment shown in FIG. 1, and the first adjustment layer 22 includes microcapsules 24 encapsulating the adhesive and a pressure-sensitive adhesive component which was another element of the ink layer 5 of the first embodiment.

As was the case in Example 1, a dry transfer material was made from the ink ribbon of the second embodiment and its pressure-sensitive transferability was examined. It was found that a transferred image having an excellent quality without collapses, spreadings, and brittleness was obtained because the adhesive that flows from the ruptured microcapsules stiffened quickly and the silicon oil mold releasing agent flowed quickly causing the adhesion between the second adjustment layer 26 and the transfer sheet 10 to decrease commencing immediately.

Moreover, because the adhesive stiffened in a very short time, while simultaneously attaining its strength, and the silicon oil mold releasing agent quickly decreased the adhesion between the second adjustment layer 26 and the transfer sheet 10 it was found the transferred image was obtained in a very short time.

The results obtained by measuring the resistance to scratching of the transferred image obtained with the above-mentioned method and that from the conventional transferred image are shown in FIGS. 5(B) and 5(C). Sample 2 is based on the transferred image obtained by using the dry transfer material made from the second embodiment of the ink ribbon of the invention.

The results of comparing the conventional transferred image showed that the adhesiveness between the transferred image obtained from using the dry transfer material made from the ink ribbon of Example 2 and the receiving material is greatly improved over that of the conventional ribbon produced dry transfer material. It is found that the scrape-resistance is greatly improved and increased because the transferred image is firmly transferred to the receiving material.

In addition, because the Example 2 is two-layer structure, there is no problem such as that which happens at the boundary of the second adjustment layer 6 and the ink layer 5 of the three layer first embodiment of Example 1. As a result, the scrape or scratch-resistance is greatly improved as compared with that of Example 1.

Further, the results obtained by observing and comparing the shelf life of the dry transfer material and of the transferred image produced from the second embodiment ink ribbon and a conventional ink ribbon, as was done with Example 1, are shown in FIGS. 6(B) and 6(C), and FIGS. 7(B) and 7(C) respectively.

In Example 2, the first adjustment layer 22 containing the microcapsules 24 encapsulating the adhesive and the second adjustment layer 26 containing the microcapsules 28 encapsulating the silicon oil mold releasing agent having an excellent heatproof and water repellent characteristics were used. As a result, the dry transfer material and the transferred image obtained therefrom, in example 2, showed no cracks, bleedings and/or changes of hue even after 480–720 hours had passed. However, the conventional transferred image showed cracks, bleedings and/or changes of hue before 240 hours had passed with their numbers increasing with the passage of time. Therefore, it was found that the shelf life of the conventional transferred image deteriorated over time while that prepared using the ink ribbon of the first and second embodiments showed no such deterioration.

While this invention has been described in connection with specific embodiments thereof, many alternatives, modifications and variations will be apparent to those skilled in the art.

Accordingly, the preferred embodiments of the invention as set forth herein are intended to be illustrative, not limiting. Various changes may be made without departing from the spirit and scope of the invention as defined in the following claims.

What is claimed is:

1. An image-transferable ribbon to be used for producing a transfer sheet, the ribbon comprising:

a ribbon substrate material;

a transfer layer formed on said ribbon substrate material, said transfer layer including a dry type image-transferring material, a first microcapsule encased adhesive, and a second microcapsule encased mold releasing agent.

2. The image-transferable ribbon as defined in claim 1, wherein said transfer layer includes a first retransfer adjustment layer formed directly on said ribbon substrate material, said first retransfer adjustment layer including said first microcapsule encased adhesive with said dry image-transfer material and said second microcapsule encased mold releasing agent included in a remaining portion of said transfer layer overlying said first retransfer adjustment layer.

3. The image-transferable ribbon as defined in claim 2, wherein said transfer layer includes a second retransfer adjustment layer said second retransfer adjustment layer including said second microcapsule encased mold releasing agent and overlying as an outer layer a portion of said transfer layer formed directly on said ribbon substrate.

4. The image-transferrable ribbon as defined in claim 3, wherein said layer includes an ink layer including said dry image-transferring material, said ink layer between said first and second retransfer adjustment layers.

5. The image-transferrable ribbon as defined in claim 3, wherein said dry image-transferring material is contained in said second retransfer adjustment layer.

6. The image-transferable ribbon as defined in claim 1, wherein the diameter of each said first and second microcapsule is 0.1–20 micrometers.

7. The image-transferable ribbon as defined in claim 1, wherein the outside wall of each said first and second microcapsule is formed to be ruptured by a force of 50 $g/cm^2$–2000 $g/cm^2$.

8. The image-transferable ribbon as defined in claim 2, wherein said first retransfer adjustment layer containing said first microcapsule encased adhesive is 1–20 micrometers thick.

9. The image-transferable ribbon as defined in claim 3, wherein said second retransfer adjustment layer containing said second microcapsule encased mold releasing agent is 1–20 micrometer thick.

10. The image-transferable ribbon as defined in claim 1, wherein the material forming an outside wall of each said first and second microcapsule comprises one of a group of materials consisting of melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ethermaleic anhydride copolymers, urea-formalin resin, melamine-formalin resin, polyurethane resin, and polyurea.

11. An ink ribbon for producing dry transfer materials comprising:

a ribbon substrate;

an adhesive layer adhered to said ribbon substrate, said adhesive layer containing a microcapsule encased adhesive;

an ink layer adhered over said adhesive layer, and a release layer adhered over said ink layer, said release layer containing a microcapsule encased mold releasing agent.

12. The ink ribbon as claimed in claim 11, wherein said ink layer contains a coloring agent.

13. The ink ribbon as claimed in claim 11, wherein a diameter of said microcapsules is in a range of 0.1 to 20 micrometers.

14. The ink ribbon as claimed in claim 13, wherein the range of said diameter is 0.5 to 10 micrometers.

15. The ink ribbon as claimed in claim 11, wherein said release layer is 1 to 20 micrometers thick.

16. The ink ribbon as claimed in claim 15, wherein said release layer is 1 to 10 micrometers thick.

17. The ink ribbon as claimed in claim 11, wherein said adhesive layer is 1 to 20 micrometers thick.

18. The ink ribbon as claimed in claim 17, wherein said adhesive layer is 1 to 10 micrometers thick.

19. The ink ribbon as claimed in claim 11, wherein said microcapsules rupture under a pressure in a range of 50–2000 $g/cm^2$.

20. The ink ribbon as claimed in claim 17, wherein said range where said microcapsules rupture is 200–1000 $g/cm^2$.

21. The ink ribbon as claimed in claim 12, wherein said release layer and said ink layer are a single layer having said coloring agent therein.

* * * * *